United States Patent [19]

Sayles

[11] 4,441,942

[45] Apr. 10, 1984

[54] EMBEDMENT SYSTEM FOR ULTRAHIGH-BURNING RATE PROPELLANTS OF SOLID PROPULSION SUBSYSTEMS

[75] Inventor: David C. Sayles, Huntsville, Ala.

[73] Assignee: The United States of America as represented by the Secretary of the Army, Washington, D.C.

[21] Appl. No.: 455,366

[22] Filed: Jan. 3, 1983

[51] Int. Cl.[3] ..... C06B 45/10

[52] U.S. Cl. ..... 149/19.6; 149/19.8; 149/76; 149/113; 149/38; 149/92; 149/114; 149/42; 149/98; 102/287; 102/290; 102/289; 102/292

[58] Field of Search ..... 102/285, 287, 289, 290, 102/291, 292; 149/19.6, 19.8, 38, 42, 76, 92, 98, 113, 114

[56] References Cited

U.S. PATENT DOCUMENTS

| | | | |
|---|---|---|---|
| 3,883,374 | 5/1975 | Rosher | 149/38 X |
| 3,932,241 | 1/1976 | Sayles | 149/19.6 X |
| 3,986,907 | 10/1976 | Dillehay | 149/19.6 X |
| 4,029,529 | 6/1977 | Elrick et al. | 149/19.6 X |
| 4,102,953 | 7/1978 | Johnson et al. | 149/19.8 X |
| 4,221,617 | 9/1980 | Rudy et al. | 149/19.6 X |
| 4,288,262 | 9/1981 | Flanagan et al. | 149/92 X |

*Primary Examiner*—Peter A. Nelson

*Attorney, Agent, or Firm*—John H. Raubitschek; Werten F. W. Bellamy; Jack W. Voigt

[57] ABSTRACT

An improved embedment system is disclosed which is comprised of an embedment granule portion in percent by weight of nitrocellulose of about 23.0, nitroglycerine of about 15.0, resorcinol of about 1.5, 2-nitrodiphenylamine of about 1.0, ammonium perchlorate (10 micrometers) of about 45.5, and aluminum powder (20 micrometers) of about 14.0 and an embedment resin portion in percent by weight of bisphenol A-epichlorohydrin of about 44, epoxidized dimer acid of about 20, and a curative which is the condensation product of 2 moles of 1,2-bis(maleimido)ethane and one mole of triaminotriazine of about 36.0. This embedment system has superior characteristics of a high peel strength and greater resistance to penetration by or absorption of carboranylmethyl propionate or casting solvent absorption.

1 Claim, No Drawings

EMBEDMENT SYSTEM FOR ULTRAHIGH-BURNING RATE PROPELLANTS OF SOLID PROPULSION SUBSYSTEMS

DEDICATORY CLAUSE

The invention described herein may be manufactured, used, and licensed by or for the Government for governmental purposes without the payment to me of any royalties thereon.

BACKGROUND OF THE INVENTION

The interface composition system for a solid propellant rocket motor grain and insulation is generally comprised of an embedment powder and an embedment resin which comprise an embedment system. A compatibility between the grain composition and the embedment system is necessary since this system functions as an interface between the propellant grain and the insulation system. Requirements of an embedment system include a high peel strength and a resistance to penetration by or absorption of catalyst components or casting solvent components contained in the propellant composition. Without proper peel strength and resistance to penetration the bond strength to the propellant and insulation is adversely effected. The burning rate of the propellant grain would also be adversely affected as well as the smooth burning rate because of poor adhesion to the embedment system.

An embedment system for use in conjunction with a crosslinked, carboranyl-catalyzed, composite-modified, double-base propellant composition differs from the propellant composition with which it is used in the following aspects: the embedment powder contains no carboranyl burning rate accelerator, no aluminium whiskers, and the particle size of the ammonium perchlorate has a considerably larger weight-mean-diameter. The other portion of the embedment system is an embedment resin portion composed of bisphenol A-epichlorohydrin (EPON 828) and epoxidized Dimer* acid (EPON 871). (Emery Industries of Cincinnati, Ohio is a major supplier of dimerized oleic acid which is marketed as Dimer* acid.) The curative presently used consists of a blend of meta-phenylenediamine, methylenedianiline, isopropyl meta-phenylenediamine and dinitrophenol as accelerator. This sytem is a diamine-cured epoxy embedment system.

The above described embedment system has several limitations and has proven to be unsatisfactory because of lower than required peel strength and a lower resistance to penetration by an absorption of catalyst and the casting solvents from the propellant composition.

Therefore, an object of this invention is to provide an embedment system for composite-modified double-base propellant composition which has superior characteristics to the diamine-cured epoxy embedment resin.

A further object of this invention is to provide a polyimide embedment system for composite-modified double-base propellant which has superior characteristics when compared to the characteristics of a diamine-cured epoxy embedment system.

SUMMARY OF THE INVENTION

The embedment system of this invention comprise an embedment granule portion in combination with an embedment resin portion that is cured with a substituted polybismaleimide prepared by the interaction or condensation of 2 moles of 1,2-bis(maleimido)ethane with one mole of triaminotriazine (melamine) at 80°-100° C. to yield the low-molecular weight reaction prepolymer (e.g., molecular weight range—2000-2500). This prepolymer, when incorporated into the embedment resin matrix, reacts with epoxy resins. The result is a superior embedment system for a composite-modified double-base propellant composition. The embedment system when cured has superior characteristics, and when the propellant is cast-in-place and cured to the embedment system these superior characteristics include a high peel strength and greater resistance to penetration by or absorption of carboranylmethyl propionate (catalyst) or casting solvent absorption. The superior embedment system is comprised of bisphenol A-epichlorohydrin (EPON 828) 44 parts, epoxidized Dimer acid (EPON 871) 20 parts, and cured with a condensation product comprised of 2 moles of 1,2-bis(maleimido)ethane and one mole of triaminotriazine, 36 parts.

DESCRIPTION OF THE PREFERRED EMBODIMENT

The superior embedment system of this invention is a polyimide embodiment system for use with a composite-modified double-base propellant composition to achieve superior peel strength and resistance to penetration and absorption of the carboranylmethyl propionate and casting solvent from the propellant composition.

Table I illustrates the polyimide embedment system of this invention for use with a composite-modified double-base propellant composition.

TABLE I

POLYIMIDE EMBEDMENT SYSTEM FOR COMPOSITE-MODIFIED DOUBLE-BASE PROPELLANT

| COMPOSITION: INGREDIENTS | PERCENT (BY WEIGHT) |
|---|---|
| (A) EMBEDMENT GRANULE | |
| Nitrocellulose | 23.0 |
| Nitroglycerine | 15.0 |
| Resorcinol | 1.5 |
| 2-Nitrodiphenylamine | 1.0 |
| Ammonium perchlorate (10 Micrometers*) | 45.5 |
| Aluminum powder (20 Micrometers*) | 14.0 |
| (B) EMBEDMENT RESIN | |
| EPON 871 | 20 |
| EPON 828 | 44 |
| **CONDENSATION PRODUCT 1,2-Bis(maleimido)ethane + Triaminotriazine | 36 |

*Weight-mean-diameter particle size
**Molecular Weight Range - 2000-25000

Table II illustrates a currently used embedment system for use with a composite-modified double-base propellant composition. This system is for comparison purposes to illustrate the presently used embedment system formulation comprised of the embedment granule portion and the embedment resin portion cured with a blend of meta-phenylenediamine, methylenedianiline, isopropyl meta-phenylenediamine and dinitrophenol as accelerator.

TABLE II

EMBEDMENT SYSTEM FOR COMPOSITE-MODIFIED DOUBLE-BASE PROPELLANT

| COMPOSITION: INGREDIENTS | PERCENT (BY WEIGHT) |
|---|---|
| (A) EMBEDMENT GRANULE | |
| Nitrocellulose | 23.0 |
| Nitroglycerine | 15.0 |

TABLE II-continued

| EMBEDMENT SYSTEM FOR COMPOSITE-MODIFIED DOUBLE-BASE PROPELLANT | |
|---|---|
| COMPOSITION: INGREDIENTS | PERCENT (BY WEIGHT) |
| Resorcinol | 1.5 |
| 2-Nitrodiphenylamine | 1.0 |
| Ammonium perchlorate (10 Micrometers) | 45.5 |
| Aluminum powder (20 Micrometers) | 14.0 |
| (B) EMBEDMENT RESIN | |
| EPON 828* | 44 |
| EPON 871** | 20 |
| CURING AGENT*** | 36 |

*Bisphenol A-epichlorohydrin
**Epoxidized Dimer acid
***Blend of Meta-Phenylenediamine, Methylenedianiline, Isopropyl Meta-Phenylenediamine and Dinitrophenol as Accelerator Table III sets forth data which includes the properties and test data for comparison of a diamine-cured (prior art) and an imine-cured embedment system of this invention.

TABLE III

| COMPARISON OF DIAMINE- AND IMINE-EMBEDMENT SYSTEMS | | |
|---|---|---|
| PROPERTY | DIAMINE-CURED | IMINE-CURED |
| Tensile strength (PSI) | 2800 | 4000 |
| Strain @ Max Stress (%) | 55 | 87 |
| Tack at Ambient temp. | Fair | Very Good |
| Resistance to high humidity | Fair | Very Good |
| Void formation | Few | None |
| Weight gain after immersion in casting solvent at 140° F. for 21 days. (%) | 19–20 | 0–5 |
| Weight gain after immersion in carboranylmethyl propionate at 140° F. for 21 days (%) | 40–45 | 0–5 |
| EMBEDMENT SYSTEM-TO-PROPELLANT INTERFACE | | |
| Bond-in-tension (PSI) Crosshead speed 2-in/min | 250 | 360 |
| 90° Peel — Crosshead speed 0.02 in/min (PL1) | 5–9 | 18–20 |
| 90° Peel — Crosshead speed 2.0 in/min (PL1) | 9–12 | 30–35 |

*The mechanical properties of the two resins were tested by casting the resins into ½-inch thick dogbone tensile specimens that were ½-inch wide at the gage section. The specimens were tested at 77° F. at a crosshead speed of 0.2 in/min. The data, listed in Table III show that the imine-cured resin is markedly superior to the diamine-cured resin.
**Voids in the casebond area may be detected by submerging a propellant/casebond specimen in a silicone resin, pressurizing, relieving the pressure, sectioning the sample, and looking for silicon atoms by energy dispersion. To do this, one-inch cubes of propellant with casebond on one face which were obtained from a grain casting were immersed in uncured General Electric RTV silicone rubber; (this rubber wets the propellant, and, as a result, would wick into any voids). The specimens are pressurized to 1000 and 2000 psi in a container, and held for three minutes. The excess RTV rubber is removed, and the rubber is cured overnight at 125° F. The cubes are microtomed, and the casebond region is examined for silicon atoms using energy dispersive X-ray.

The chemical reaction equations No. 1, set forth below, illustrates the preparation of the substituted polybismaleimide (curing compound for resins) by the interaction of 2 moles 1,2-bis(maleimido)ethane with one mole of triaminotriazine.

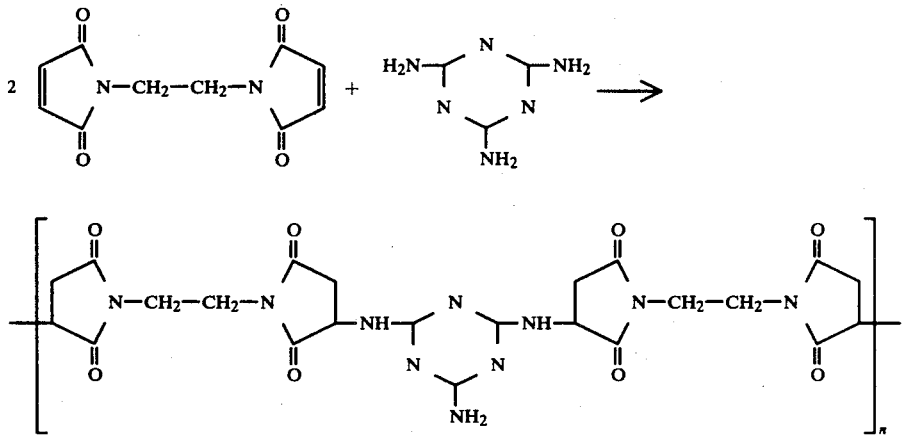

Chemical Reaction Equation No. 1: Interaction of 1,2-Bis(maleimido)ethane and Triazine

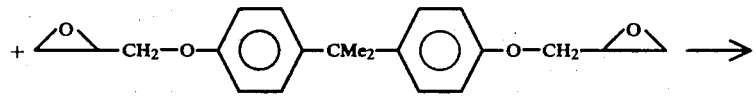

-continued

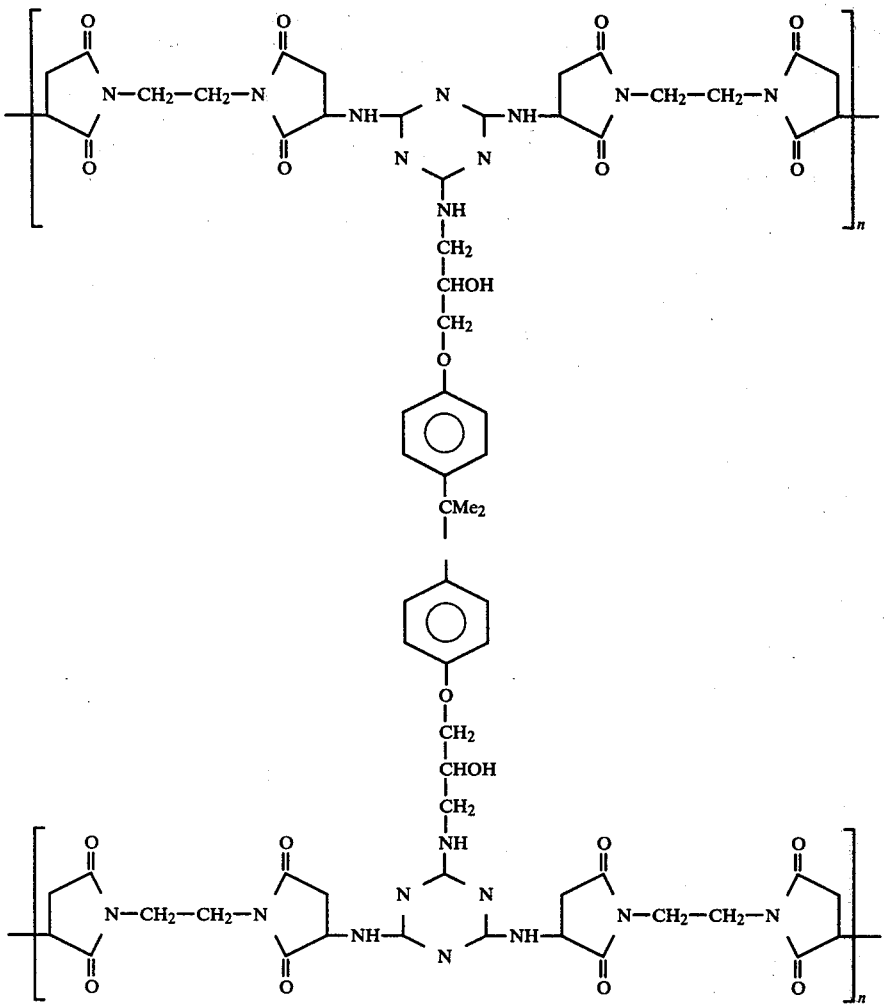

Chemical Reaction Equation No. 2:
Reaction Of The Condensation Product of 1,2-Bis(maleimido)ethane and Triazine with the Reaction Product of Epichlorohydrin and Bisphenol A

EPON 828 DIGLYCIDYL ETHER OF BISPHENOL A

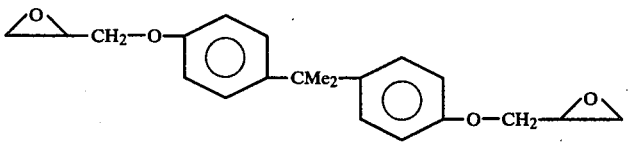

EPON 871 EPOXIDIZED DIMER (OLEIC ACID) ACID

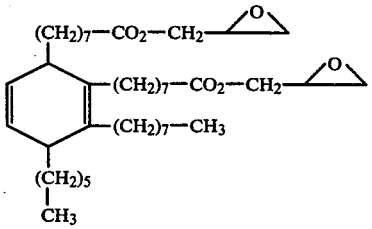

I claim:

1. An embedment system for use with a composite-modified double-base propellant composition, said embedment system comprised of an embedment granule portion (A) which comprises ingredients (i–vi) in percent by weight as follows:

(A) embedment granule portion:

(i) nitrocellulose: 23.0;

(ii) nitroglycerine: 15.0;
(iii) resorcinol: 1.5;
(iv) 2-nitrodiphenylamine: 1.0;
(v) ammonium perchlorate (10 micrometers weight-mean-diameter particle size): 45.5; and,
(vi) aluminum powder (20 micrometers weight-mean-diameter particle size): 14.0; and, an embedment resin portion (B) which comprises ingredients (i–iii) in percent by weight as follows:

(B) embedment resin portion:

(i) bisphenol A epichlorohydrin: 44.0;
(ii) epoxidized dimer acid: 20.0; and,
(iii) condensation product of 2 moles of 1,2-bis(-maleimido)ethane with one mole of triaminotriazine: 36.0, said condensation product prepared by reacting said 1,2-bis(maleimido)ethane and said triaminotriazine at 80°–100° C. to yield a low molecular weight reaction prepolymer for curing said bisphenol A-epichlorohydrin and said epoxidized dimer acid.

* * * * *